United States Patent [19]

Debaes

[11] Patent Number: 5,020,573

[45] Date of Patent: Jun. 4, 1991

[54] CONTROL MECHANISM FOR THE SELECTION OF WEFT YARNS IN RAPIER LOOMS

[75] Inventor: Johnny Debaes, Wenduine, Belgium

[73] Assignee: N.V. Michel Van de Wiele, Kortrijk-Marke, Belgium

[21] Appl. No.: 469,031

[22] Filed: Jan. 23, 1990

[30] Foreign Application Priority Data

Jan. 23, 1989 [BE] Belgium ..... 8900071

[51] Int. Cl.[5] ..... D03D 47/38

[52] U.S. Cl. ..... 139/453; 139/455

[58] Field of Search ..... 139/453, 455, 68, 71, 139/72

[56] References Cited

U.S. PATENT DOCUMENTS

| | | | |
|---|---|---|---|
| 3,731,712 | 5/1973 | Sermet | 139/453 |
| 4,191,222 | 3/1980 | Marshall . | |
| 4,556,089 | 12/1985 | Juillard | 139/453 |
| 4,852,618 | 8/1989 | Zollinger et al. | 139/453 |

FOREIGN PATENT DOCUMENTS

| | | |
|---|---|---|
| 3716124 | 7/1988 | Fed. Rep. of Germany . |
| 2041419 | 9/1980 | United Kingdom . |

*Primary Examiner*—Andrew M. Falik

*Attorney, Agent, or Firm*—James C. Wray

[57] ABSTRACT

A control mechanism for the selection of the weft yarns in rapier looms with presenting needles on presenting levers, controlled by a plurality of levers and connecting elements from a series of electro-magnets, wherein the presenting and control levers can moves rotatably the presenting and control levers can move rotatably to and fro about the respective shafts on which they

16 Claims, 1 Drawing Sheet

CONTROL MECHANISM FOR THE SELECTION OF WEFT YARNS IN RAPIER LOOMS

BACKGROUND OF THE INVENTION

1. Field of the Invention

This invention relates generally to a control mechanism for the selection of weft yarns in rapier looms provided with presenting needles on presenting levers. Specifically, the control mechanism is controlled by a system of levers from a series of electromagnets.

2. Prior Art

Various mechanisms exist for the selection of weft yarns in rapier looms. The selected weft yarn must be clamped, cut off and presented to the rapier and, once gripped by the rapier, inserted into the shed.

Before that the various possible weft yarns, each run through an eye of the respective presenting needles. These presenting needles are connected to levers, shafts, hook elements, etc., which together form a mechanism which is controlled in one way or another to make the selected presenting needle move with its corresponding weft yarn for the presentation of the weft to the rapier.

The object of the invention is such a control mechanism. The problem with such a mechanism lies in the high speed at which rapier looms are currently running, requiring a quick response for presentation of the new weft yarn and for the withdrawal of the previous presenting needle.

There are such mechanisms in existence in which each lever, controlling its corresponding presenting needles is on one side continuously under the tensile force of a spring and thus inclined to bring the presenting needle in question back to its rest position, and on the other side cyclically under pressure of a resilient pressure finger which is pushed in by a cam disk and held in this position by an electromagnet for the time that an electric current flows through it, in accordance with the requirements of the fabric.

However, this control mechanism lacks reliability regarding control, particularly the high speeds which are presently used in rapier looms.

SUMMARY OF THE INVENTION

The object of the control mechanism for the selection of the weft yarns in rapier looms according to the invention is to remedy this shortcoming.

The control mechanism for the selection of the weft yarns in the rapier looms according to the invention is characterized by the fact, that the presenting needles are controlled by levers mounted freely on an articulating shaft, which is rocked back and forth by an eccentric mounted on the main shaft, without this reciprocating movement making the presenting needles deviate from their rest position.

The control mechanism, according to the invention, for the selection of weft yarns in rapier looms, of which the levers controlling the presenting needles hooked in with or without the intervention of an electromagnet according to whether the presenting needle in question is selected or not according to whether the particular pattern of the fabric, is further characterized by the fact that all armature blocks, fastened on the levers provided with hooked handles, are pushed once per turn against their respective electromagnets by a common push bar, mounted on a shaft, which is moved back and forth by being driven by a cam disk mounted on the main shaft.

The control mechanism, according to the invention, for the selection of the weft yarns in rapier looms, of which the levers, controlling the presenting needles, hooked with or without the intervention of an electromagnet according to whether the presenting needle in question is selected according to the particular pattern of the fabric, is further characterized by the fact that the current in the electromagnet involved flows in one direction at one time to hold the selected needle in its presenting position and next in the other direction to repel the armature block connected on the lever of the selected needle as soon as the presenting needle involved has to return to its rest position.

Further characteristics and advantages of the control mechanism for the selection of the weft yarns in rapier looms according to the invention will appear from the description of this control mechanism with reference to the accompanying figures, without this description and this figure implying a limitation of the invention to this particular embodiment.

These and further and other objects and features of the invention are apparent in the disclosure, which includes the above and ongoing written specification, including the claims and the drawings.

DETAILED DESCRIPTION OF THE INVENTION

Figure 1:
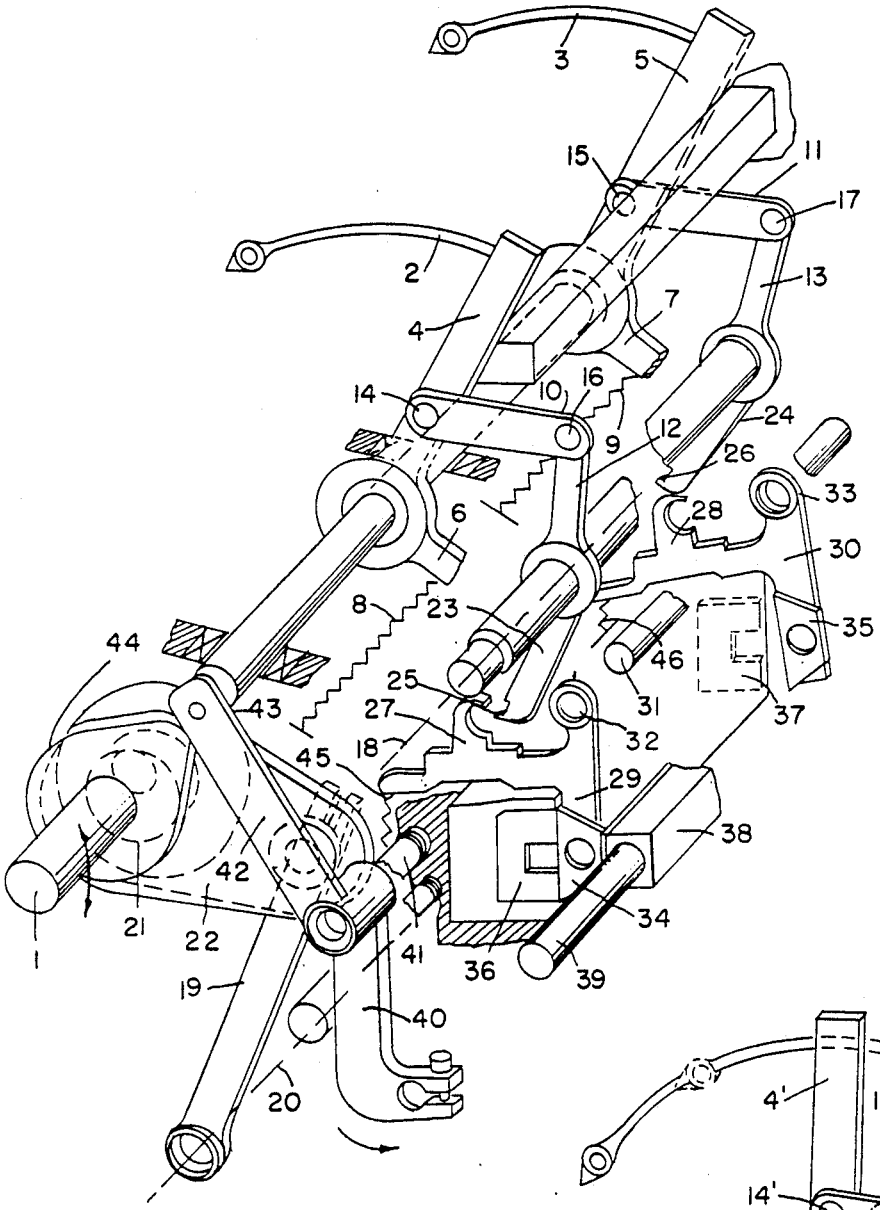
FIG. 1—shows a perspective view of the steering mechanism according to the invention.

A control mechanism for the selection of weft yarns in rapier looms according to the invention, as shown in FIG. 1, comprises several parallel shafts.

There is first, the main shaft (1), which rotates synchronously with the main shaft of the loom. On this main shaft are rotatably mounted the various presenting needles (2, 3) with their presenting levers (4, 5), with the main shaft (1) as the articulating shaft, about which the presenting levers (4, 5) with their presenting needles (2, 3) can tilt.

These same presenting levers (4, 5) have fixed to them small protruding fingers (6, 7), which are coupled to the springs (8, 9), tied to the frame of the control mechanism, that hold the presenting needles (2, 3) in their rest position and bring it back to that rest position after they have been selected and have to return to their rest position.

The tilting motion of a selected presenting needle (2, 3) is obtained by a series of levers, the connecting elements (10, 11) of which connect the presenting levers (4, 5) with the control levers (12, 13) along the joints (14, 15) and (16, 17).

The control levers (12, 13) are rotatably mounted on the shaft (18), that runs parallel to the main shaft (1), so that the control levers (12, 13) can swivel freely around the shaft (18).

The shaft (18) is mounted on the cranks (19) (only one is shown), which rock back and forth around a third shaft (20) also mounted on the cranks, the cranks are driven by an eccentric (21) mounted on the main shaft (1) and link (22).

At each rotation of the main shaft of the loom, the main shaft (1) makes one full rotation also and the shaft

(18) obtains a back-and-forth motion without the presenting needles (2, 3) deviating from their rest position, because the presenting levers (4, 5) are restrained by the springs (8, 9), while the presenting levers (4, 5) as well as the control levers (12, 13) are mounted rotatably on their respective shafts (1) and (18) and are connected by connecting elements (10, 11) along the joints (14, 15) and (16, 17).

The control levers (12, 13) have extensions (23, 24), that end in hooks (25, 26).

It suffices to hold back one of these extensions (23, 24) at the time of the back-and-forth movement of the second shaft (18) to make the corresponding lever, along its connecting element, push the presenting lever of the presenting needle selected.

To this end an electromagnet of special design is used.

Straight across from each extension (23, 24), provided with their respective hooks (25, 26) there is a complementing hook (27, 28), which is part of a right-angled lever (29, 30), which articulates around a fourth shaft (31) parallel to the main shaft (1) in its angular point (32, 33), while the other leg of this right-angled lever (29, 30) is provided with an armature block (34, 35), which can connect to the two poles of an electromagnet (36, 37), with which a magnetic field be created.

Straight across from the series of electromagnets (36, 37) is a push bar (38) provided with compression springs, mounted on a fifth shaft (39) parallel to the main shaft (1).

This shaft (39), on which the push bar is mounted, is clamped to the cranks (40) (only one crank (40) is shown), which are mounted rotatably on a shaft (41) and rock back and forth with a lever (42) controlled by a cam roller (43), attached to the lever (42) and an extension of the crank involved (40). A cam disk (44) mounted on the main shaft (1) drives the cam roller (43).

Because of this design, the push bar (38) pushes at each rotation of the main shaft (1) all the armature blocks (34, 35) against the electromagnets at a time that can be controlled by the position and shape of the cam disk (44).

At this point it suffices to energize the electromagnet (36) corresponding to the presenting needle (2) to be selected to hold the armature block (34) against the electromagnet (36), while the armature block (34) is removed from the non-energized magnets under the tensile force of the spring (45), when the push bar (38) moves away from these electromagnets driven by the rocking levers (40, 42) from the cam disk (44).

Figure 2:
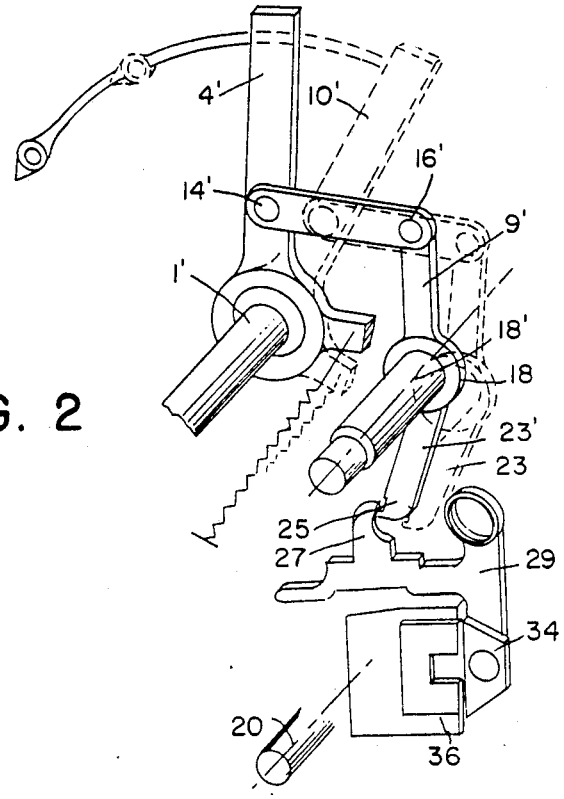
FIG. 2—shows two positions of the selected presenting needle with its levers.

Provided that the right-angled lever (29) with the armature block (34) is held against the electromagnet (36), the hook (25) of the extension (23) of the control lever (12) hooks with the complementing hook (27) of the right-angled lever (29), so that the control lever (12) tilts about the shaft (18) with a outward movement of the shaft (18) about the shaft (20), controlled from the main shaft (1). The tilting motion of the control lever (12) also causes the presenting lever (4) to tilt, so that the presenting needle (2) attached to this presenting lever (4) moves away from its rest position and takes the selected yarn to the rapier (FIG. 2).

As soon as a selected presenting needle must return to its rest position, the electromagnet (36) is energized with countercurrent for a very brief period, so that the magnetic field reduces very quickly, thereby causing, e.g., the armature block (31) involved to move away quickly from the corresponding electromagnet (36) under the tensile force of the spring (45).

The control mechanism according to the invention has the great advantage of a very brief response time to the position of the presenting needles. With the push bar (38) all armature blocks (34, 35) are pushed against the electromagnets; the selected electromagnet is then energized, so that immediately a very large attraction develops, even with a relatively weak electromagnet. This adhesiveness, as well as the remanent magnetism, is terminated by a sufficiently large countercurrent, so that the armature blocks involved are released immediately and move away from the magnet poles under the tensile force of the springs (45, 46).

While the invention has been described with reference to specific embodiments, modifications and variations of the invention may be constructed without departing from the scope of the invention, which is described in the following claims.

This control has an immediate effect on the presenting needle involved, which is mounted in such fashion, that the shafts can move freely without obstruction by the springs.

I claim:

1. A control mechanism for selection of the weft yarns in rapier looms, comprising a plurality of levers and presenting needles, the presenting needles being located on presenting levers, wherein the presenting needles are controlled by the plurality of levers and connecting elements operatively connected to a series of electromagnets having means for being energized individually, depending on the particular weft which is utilized in a fabric pattern, and wherein pivot points of the presenting levers are on a first shaft generally referred to as main shaft which is a drive shaft and wherein the connecting elements connect the presenting levers mounted on the main shaft and control levers mounted on a second shaft.

2. The control mechanism of claim 1, wherein the plurality of levers includes control levers which are pivotally mounted on the second shaft, the second shaft having means to pivot around a third shaft, the second and third shafts being rotatably mounted on a first plurality of cranks, and driven by a link and an eccentric, the link and the eccentric being rotatably mounted on the main shaft.

3. The control mechanism of claim 2, wherein the control levers are rotatably mounted on the second shaft on one end, and are articulated on the connecting elements which control the presenting levers of the presenting needles on an other end, wherein further the control levers are provided with extensions at that end which is rotatably mounted on the second shaft, the extensions having hooks at the other end, which are capable of hooking into tilting hooks, the tilting hooks forming part of the right-angled levers, the right-angled levers are provided at one end with armature blocks which are capable of being held by electromagnets.

4. The control mechanism of claim 1, wherein the presenting levers of the presenting needles are provided with projecting fingers to which traction springs are attached generally parallel to the main shaft and connected to a frame of the control mechanism, wherein the traction springs pull the presenting levers into a rest position and hold the presenting levers in a desired position.

5. A control mechanism for selection of weft yarns in gripper looms, comprising presenting needles attached to presenting levers, the presenting levers controlled by a plurality of levers from a series of electromagnets, having means for being energized individually depending on whether a particular weft yarn is selected for a fabric pattern, a push bar which is provided with local compression springs, and right-angled levers which are part of the plurality of levers, and wherein the right-angled levers are attached to armature blocks, wherein the push bar is located directly opposite the armature blocks of the right-angled levers and poles of the electromagnets having means for being controlled in a reciprocating movement in synchronism with the main shaft of the loom, and in which at an extreme position of the push bar, the armature blocks are always pushed against the poles of the electromagnets.

6. The control mechanism of claim 5, wherein the push bar is mounted on a shaft being mounted within one end of a second plurality of cranks, the other ends of the cranks being rotatably mounted on an other shaft, wherein the cranks rock back and forth about the other shaft under the control of a third lever, this lever being driven by a cam roller on a cam disk mounted on the main shaft of the loom, wherein the shaft on which the push bar is mounted rotates in synchronism with the main shaft of the loom.

7. The control mechanism of claim 5, wherein one of the electromagnets is energized so that the armature block adheres magnetically to the poles of the electromagnet at the moment that the push bar which has pushed these armature blocks against the poles of the electromagnet moves away from these electromagnets, with the result that the corresponding presenting needle presents the weft yarn thus selected to a rapier and through a counter-current control the remnant magnetism is removed, at the moment that the presenting needle in question has been retracted to a rest position, so that the corresponding armature block is released more quickly from the poles of the electromagnet involved, in order to move the corresponding armature block away from the electromagnet under the tensile force of a traction spring.

8. The control mechanism of claim 6, further comprising control levers which are pivotally connected to a sixth shaft, wherein the rocking movements of the sixth shaft and of the fifth shaft, about which the push bar of the armature blocks rocks, are controlled from the main shaft on which the presenting levers of the presenting needles are mounted in a freely articulating manner, and the main shaft having means for being driven in synchronism with the main shaft of the loom.

9. A control mechanism for selection of weft yarns in rapier looms, comprising several parallel shafts, a plurality of levers and a series of electromagnets, wherein a first shaft generally referred to as main shaft has presenting levers pivotally mounted and presenting needles are attached to the presenting levers, wherein the plurality of levers further comprises control levers pivotally connected to a second shaft at one end, and at the other end are jointly connected to connecting elements, the connecting elements are connected to the presenting levers, the second shaft is mounted on a first plurality of cranks which rock back and forth around a third shaft also mounted on the first plurality of cranks, the cranks are driven by an eccentric and link mounted on the main shaft.

10. The control mechanism of claim 9, wherein small protruding fingers are attached to the presenting levers and traction springs are attached at one end to the small protruding fingers and at the other end to a frame of the control mechanism.

11. The control mechanism of claim 9, wherein the control levers have extensions that end in hooks.

12. The control mechanism of claim 11, wherein right-angled levers are pivotally connected to a fourth shaft parallel to the main shaft, wherein the right-angled levers are provided with complementing hooks on a first leg of the right-angled lever and with armature blocks on the other leg of the right-angled lever, wherein further the complementing hooks are capable of hooking the hooks of the extension of the control lever.

13. The apparatus of claim 12, wherein the electromagnets are provided directly opposite the armature blocks so that a magnetic field may be created between the electromagnets and the armature blocks.

14. The control mechanism of claim 13, wherein a push bar is mounted on a fifth shaft parallel to the main shaft and the push bar is positioned directly across from the series of electromagnets.

15. The control mechanism of claim 14, wherein the fifth shaft is mounted within a second plurality of cranks, the second plurality of cranks being rotatably mounted on a sixth shaft, the second plurality of cranks being provided with an extension which attaches to a lever which is controlled by a cam roller, the cam roller being driven by a cam disk mounted on the main shaft.

16. The control mechanism of claim 15, wherein traction springs are attached to a right-angled lever and the sixth shaft.

* * * * *